United States Patent [19]

Striebig

[11] 4,202,231

[45] May 13, 1980

[54] DEVICE FOR CUTTING BUILDING PANELS

[76] Inventor: Ludwig Striebig, Grossmatte, CH 6014 Littau, Switzerland

[21] Appl. No.: 908,968

[22] Filed: May 24, 1978

[30] Foreign Application Priority Data

May 26, 1977 [CH] Switzerland ..... 6516/77

[51] Int. Cl.[2] ..... B27B 5/06; B26D 7/02

[52] U.S. Cl. ..... 83/453; 83/466; 83/471.2; 269/55; 269/246

[58] Field of Search ..... 83/471.2, 471.3, 472, 83/477.1, 453, 452, 466; 269/55, 71, 95, 246, 249

[56] References Cited

U.S. PATENT DOCUMENTS 3,283,790 11/1966 Striebig ..... 83/471.3

3,890,861 6/1975 Gebhardt ..... 83/471.3

*Primary Examiner*—Robert Louis Spruill

*Assistant Examiner*—W. D. Bray

*Attorney, Agent, or Firm*—Toren, McGeady and Stanger

[57] ABSTRACT

Apparatus for cutting a panel backed by an upright grid and supported edgewise by a horizontal row of rollers, the grid and rollers defining a working surface, includes a power saw that may be moved in the working surface, an abutment which may abuttingly engage a vertically extending edge portion of the panel and thereby bound the working surface in one horizontal direction, and a clamping mechanism vertically movable on a guide column for clamping the edge portion to the column. Unless located so as not to interfere with the start of a horizontal cut, the column and abutment may be moved away from the working surface temporarily.

14 Claims, 11 Drawing Figures

DEVICE FOR CUTTING BUILDING PANELS

Figure 1A:
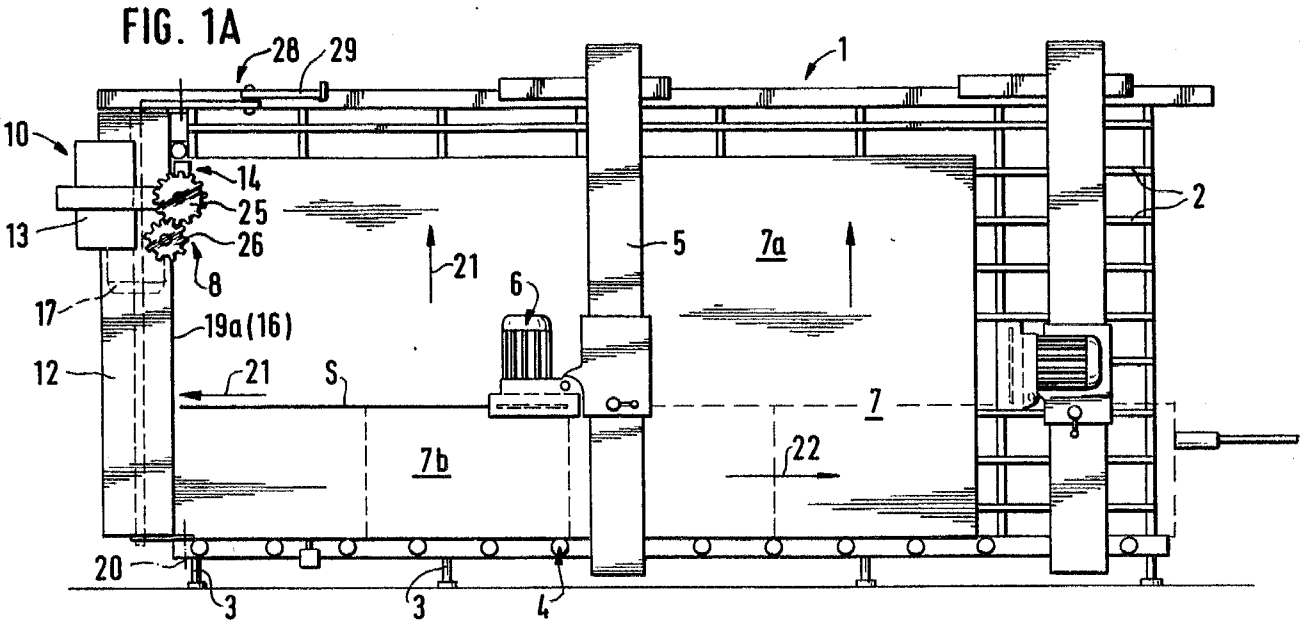

The present invention relates to a device for cutting building panels of hardboard, plywood, synthetic resin etc. which includes an approximately vertical frame on which the panel to be cut is backed by a grid while its lower edge rests on a horizontal carrier. A power saw is vertically movable on a saw beam which can be moved horizontally on the frame. A vertical edge of the panel may be gripped in a clamping device mounted on a slide which may move on a guide column at one side of the frame.

In apparatus disclosed in German Pat. No. 2,305,673, a panel to be cut is supported approximately upright on a horizontal carrier, and the upper panel part is held fast while a lower part is severed by a horizontal cut, further subdivided and removed. Thereafter, the upper panel part is lowered to the carrier and further divided.

In the known apparatus, the panel clamping elements are movable on a frame and grip both vertical panel edges so that the panel does not rest against a backing without stress, and a straight cut cannot be made.

Because the clamping elements must be adjustable horizontally for accommodating panels of different length in the known device, a backing grid cannot be continuous without colliding with the moving clamping elements, and thereby provides ineffective support for panels of certain dimensions.

It is the object of this invention to provide more ready access to a panel edge held by a clamping device, especially during sawing.

This is achieved by the provision of a guide column, a slide vertically movable on the column, an abutment on the column for the associated vertical panel edge, and by a clamping jaw arrangement on the slide whose clamping surfaces are short in a vertical direction.

Figure 1B:
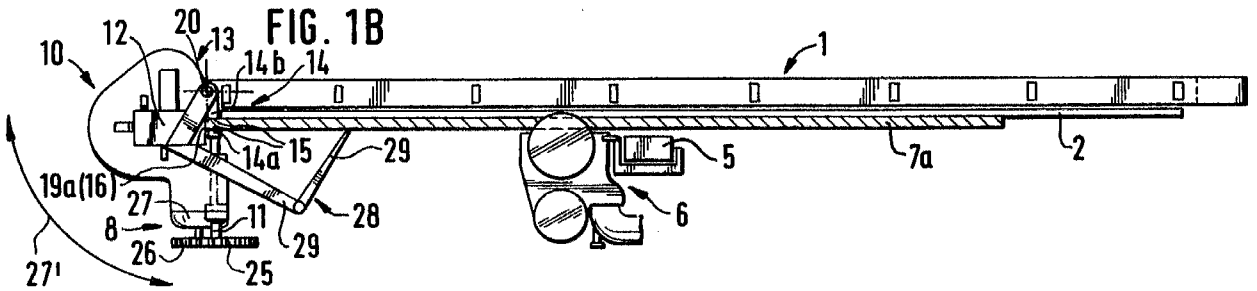
Figure 1C:
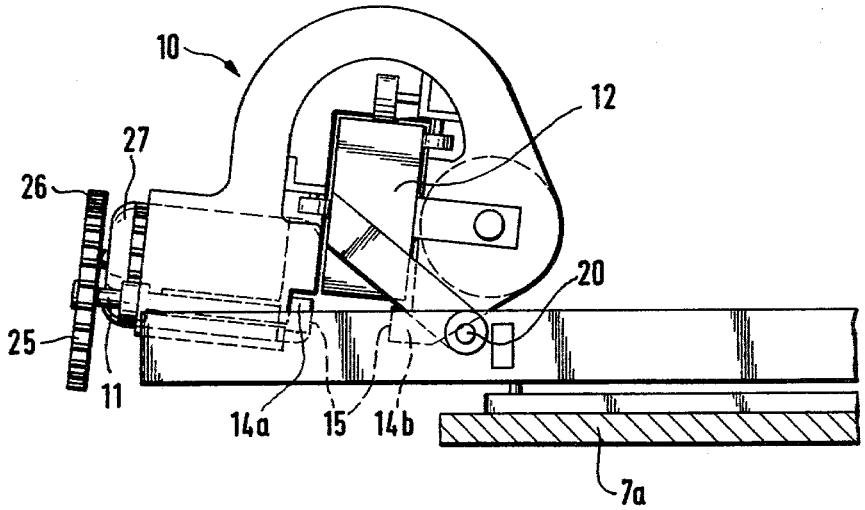

Further features of the invention will become apparent from the following detailed description of exemplary embodiments, when considered with the drawing in which:

FIGS. 1A, 2A, 3A, 4A, and 5A show devices according to the invention in respective front elevations:

FIGS. 1B, 2B, 3B, 4B, and 5B show the same devices in respective top plan views; and FIG. 1C is an enlarged partial view of the device of FIG. 1B in a different operating position.

The several illustrated cutting devices have the same basic structure including a horizontally elongated, approximately upright frame 1 carrying a supporting grid 2 for backing the panel to be cut while carrier rollers 4 movably support the horizontal, lower panel edge. The frame 1 rests on feet 3. A vertically elongated saw beam 5 is guided along the frame 1 and movably carries a power saw 6. The saw 6 may be tilted on the beam between the position shown on the right of each of FIGS. 1A to 5A for making vertical cuts and that illustrated in the middle of each of FIGS. 1A to 5A for making horizontal cuts. The power saw 6 moves vertically on the beam 5 for vertical cuts, and the beam 5 moves horizontally with the saw for horizontal cuts. This is basically known, for example, from Austrian Pat. No. 231,690.

When a panel 7 is to be sawn along a horizontal line S into an upper portion 7a and a lower portion 7b, the upper panel portion 7a must be secured during sawing so that it cannot drop under its own weight and narrow the cut. The left side of the frame 1, as viewed in FIGS. 1A to 5A, is provided with a clamping device 10 which includes an almost vertical column 12 on which a slide 13 is longitudinally guided. A clamping jaw arrangement 14 on the slide has clamping faces 15 which engage an upright edge portion of the panel.

The column 12 is rectangular in cross section, and the slide 13 is approximately U-shaped and open toward the working surface on the backing grid 2 in the position shown in FIGS. 1A and 1B. The two legs of the U-shape respectively carry a fixed jaw 14b and an opposite jaw 14a whose clamping face 15 may be driven toward a corresponding face of the jaw 14b by a drive 8. The drive includes a spindle 11 guided on the slide 13, a gear wheel 25 on the spindle, and a pinion 26 meshing with the gear wheel and coupled to a motor 27. The vertical length of each clamping face 15 is small compared to the panel 7, and its horizontal width is equally small so that engagement of the clamping faces 15 with the panel portion 7a is limited to the upper left-hand corner of the panel.

The slide 13 is guided on three angularly offset column surfaces by rollers 23 (FIG. 1C) and shifted vertically by a motor 17 and a rack-and-pinion drive (not shown).

In the embodiment illustrated in FIGS. 1A, 1B, 1C, a longitudinal surface 19a of the column 12 normally limits movement of the panel 7 on the carrier rollers 4 toward the column, but the column may be pivoted about vertical pins 20 on the frame 1 between the positions of FIGS. 1B and 1C as indicated by an arrow 27'. In the latter position, the column 12 and the elements supported thereon are located behind the working surface of the grid 2 and give access to the left edge portion of the upper panel portion 7a. Cuts may be performed by means of the saw 6 from the left to the right for cutting relatively small pieces from the panel. The clamping jaws 14a, 14b are released from the panel as needed by manual control of the drive 8, and the column 12 is swung manually thereafter.

The column 12 may also be swung out of the path of the saw 6 by a non-illustrated pivoting mechanism controlled by an arm 28 carrying a contact sensor 29, and return of the column to the position of FIG. 1B may be initiated equally by the sensor 29 which also may cause closing and opening of the jaw arrangement 14 by starting and stopping the motor 27.

In operating the illustrated apparatus, a panel 7 is first lowered on the carrier rollers 4, pushed against the grid 2, and moved into abutting engagement with the surface 19a of the column 12, as indicated by an arrow 27'. Before a cut is made along the line S from the left toward the right, as indicated by an arrow 22, the column 12 is swung briefly into its retracted position shown in FIG. 1C to permit the cut to be started. When the saw 6 has moved far enough, the column 12 is returned to its operative position, and the upper panel portion 7a is gripped by the jaws 14a, 14b and also held in position by abutting engagement with the column face 19a. After the cut is completed, the severed upper panel portion 7a is lifted slightly by means of the motor 17 to facilitate removal of the lower panel portion 7b, and the panel portion 7a thereafter is lowered to the carrier rollers 4 for another horizontal cut if desired.

Figure 2A:
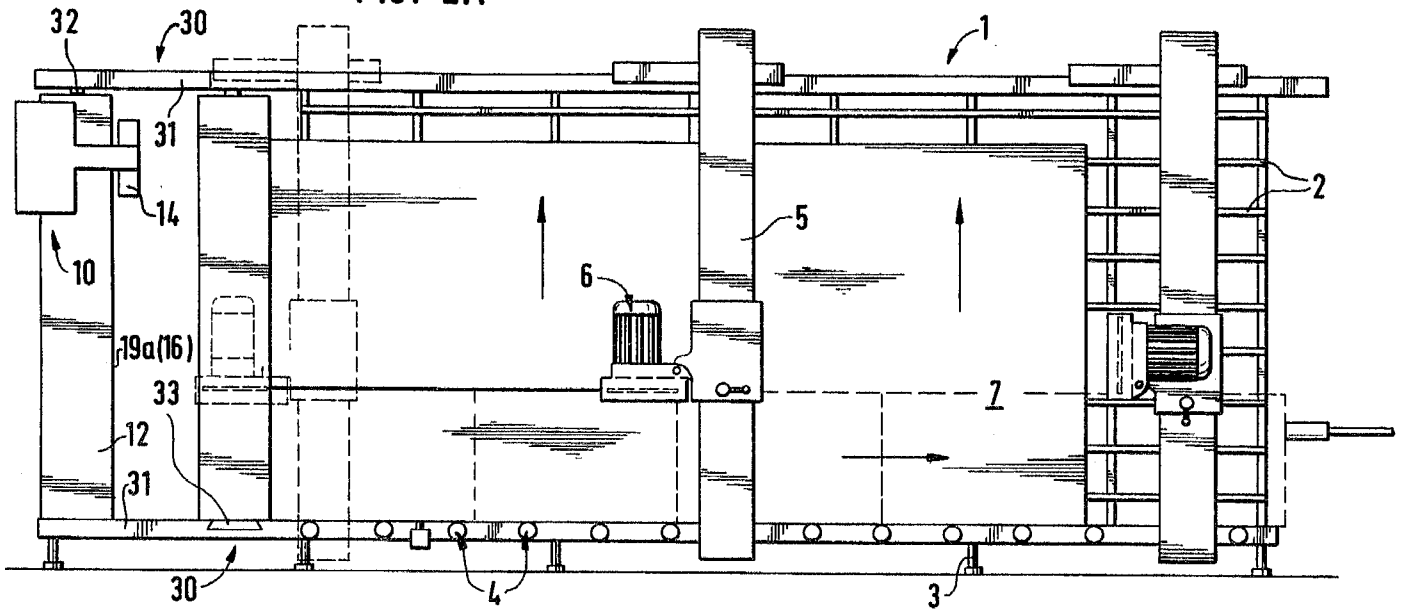
Figure 2B:
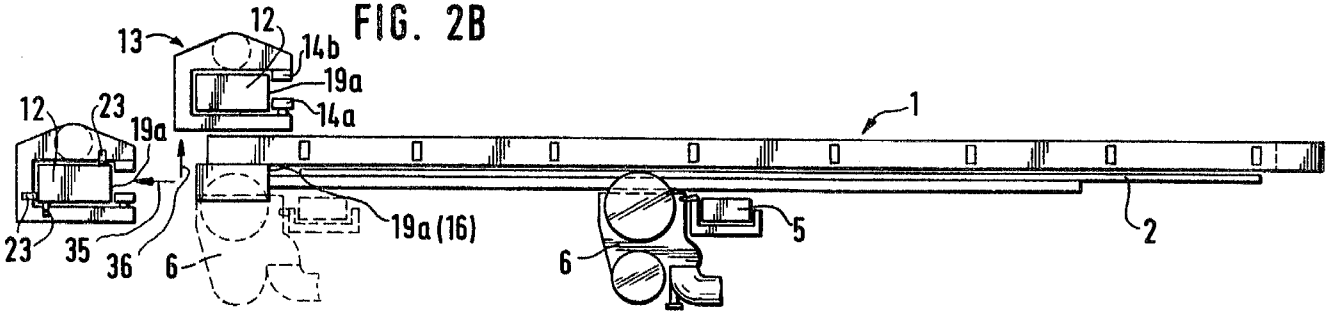

The apparatus illustrated in FIGS. 2A 2B differs from that described above with reference to FIGS. 1A, 1B, 1C by a guide column 12 which may be moved manually between upper and lower guide elements not only parallel to the frame 1, as indicated by an arrow 35

(FIG. 2B), but also backward from the working surface in the direction of an arrow 36. The column is guided between guide rails 31 by overhead rollers 32 and grooves 33 near the bottom of the frame 1 and transverse to the grid 2. The rectilinear movements of the column 12 in the directions of the arrows 35, 36 may also be initiated automatically by the sensor 29, shown only in FIGS. 1A and 1B, upon contact with the saw beam 5. The guide column 12 is shifted while the clamping jaws 14*a*, 14*b* are open and remains in one of its positions offset from the edge of the panel and indicated on the left of FIG. 2B until the saw 6 has moved out of the position indicated by broken lines, whereupon the jaws 14*a*, 14*b* may be clamped to the edge of the upper panel portion.

Figure 3A:
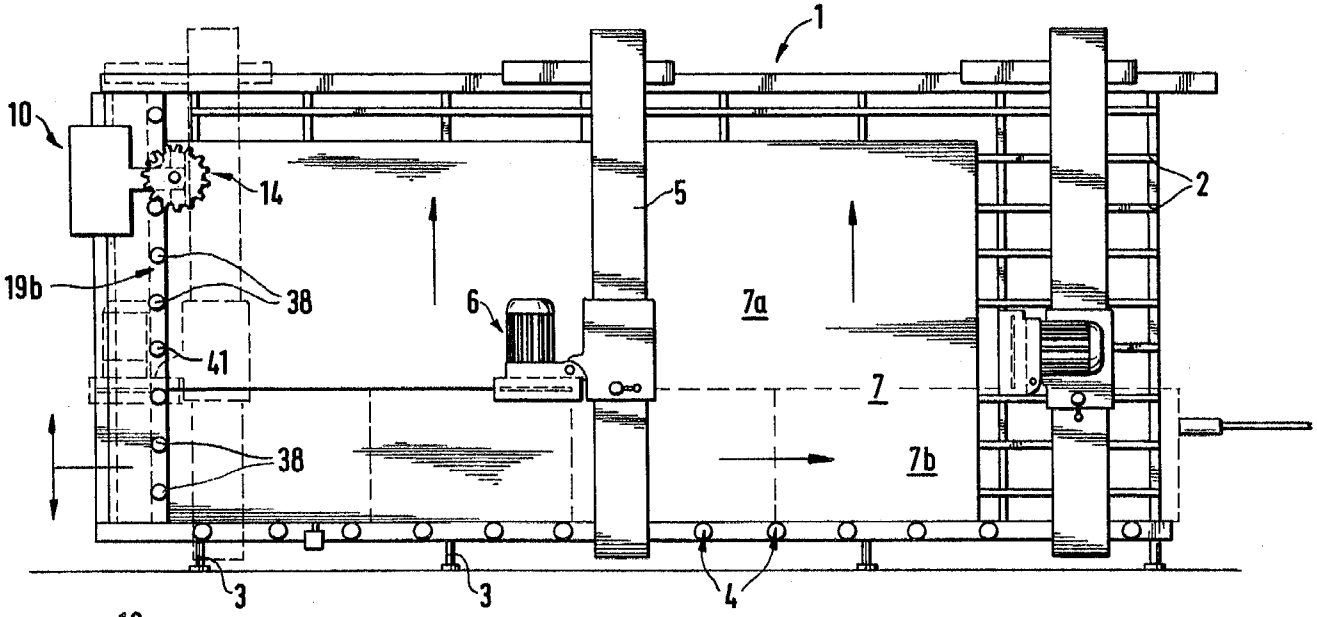
Figure 3B:
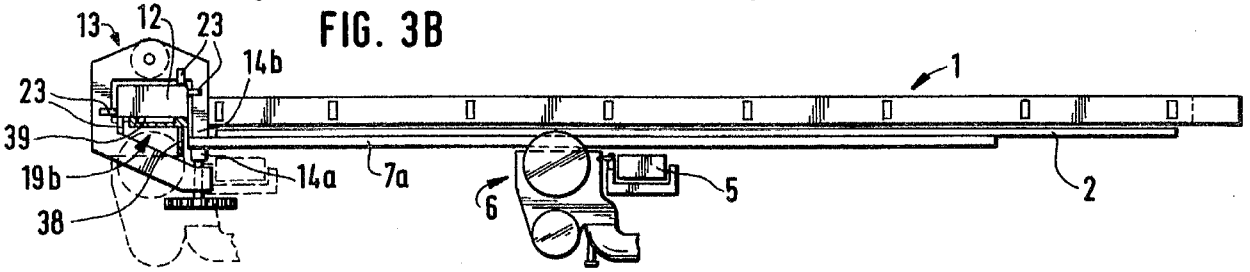

In the embodiment of the invention shown in FIGS. 3A and 3B, a guide column 12 is fixedly mounted on the frame 1 behind the working surface defined by the grid 2 and the rollers 4 of the bottom edge support. A carrier rail 19*b* is longitudinally movable on the column 12 and carries vertically spaced stop members 38 which project into the working surface for abutting engagement by a vertical edge of the panel. A slide 13 carrying a clamping jaw arrangement 14 is movably mounted on the column 12 as described above.

The stop members 38 include rollers 41 rotatably mounted on pins which project transversely from the rail 19*b*, but the rollers may be omitted. The rail 19*b* is vertically guided on the column 12 by a dovetail joint 39 which permits the rail to be moved even when the stop members 38 are engaged by a panel so that the blade of the power saw may enter the gap between adjacent stop members 38 to start a cut in the panel from the left to the right as indicated in broken lines in FIG. 3B. The minimum spacing of the stop members 38 is chosen to suit the width of the saw blade.

If the stop members are stationary, they are preferably made of plastic or light metal which does not damage or scratch the saw blade.

The guide column 12 shown in FIGS. 3A, 3B is rectangular in cross-section and partly enveloped by a U-shaped slide 13. However, one leg portion of the slide angularly diverges from the column 12 to bound therewith a space of triangular shape in the view of FIG. 3B which accommodates the rail 19*b* and the stop members 38. The clamping jaw arrangement 14*a*, 14*b* is the same as in the afore-described embodiments.

Figure 4A:
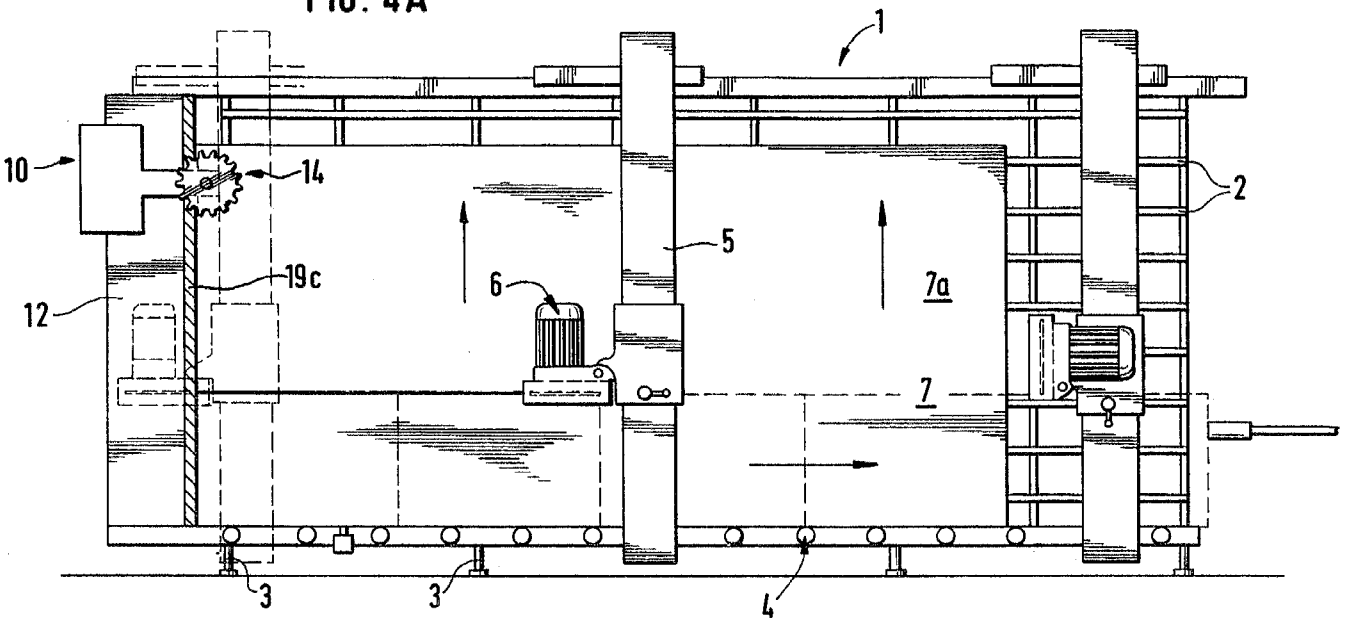
Figure 4B:
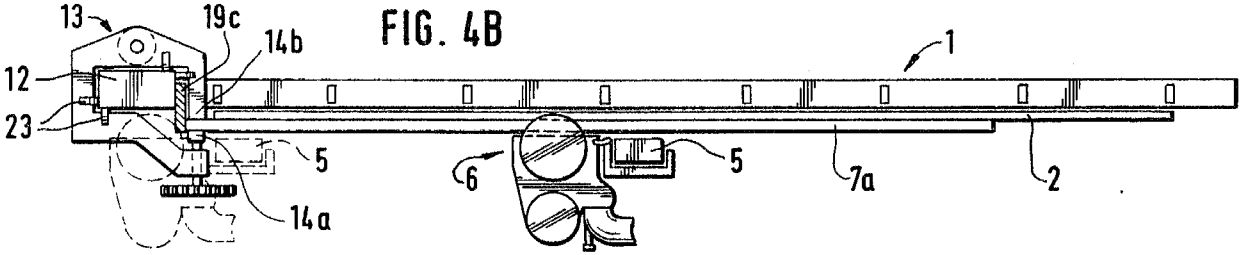

In the device illustrated in FIGS. 4A, 4B, the column 12 is fixedly attached to the frame 1 behind the working surface. A slat 19*c* is fixed on the column 12 and projects into the working surface as a stop for a vertical edge of the panel 7. The slat 19*c* preferably consists of wood, but may also consist of plastic or aluminum which is sufficiently rigid for its action on the panel, but readily cut by the blade of the power saw 6 when a horizontal cut in the panel is to start from the left, upright panel edge, as viewed in FIGS. 4A, 4B. The slat 19*c* may have to be replaced from time to time after being cut.

Figures 5A, 5B:
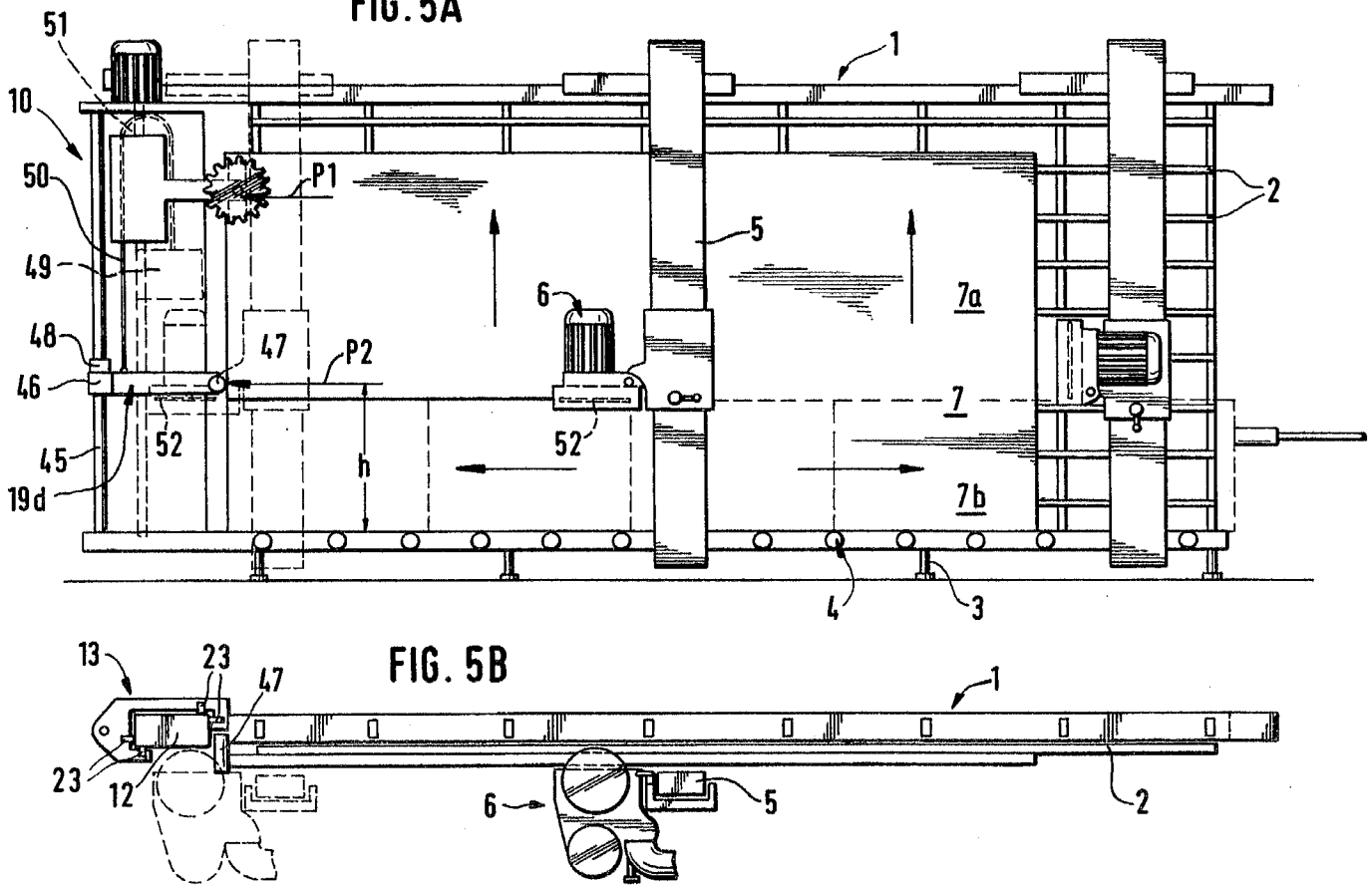

The device shown in FIGS. 5A, 5B includes a guide column 12 fixedly mounted on the frame 1 behind the working surface. A guide rod 45 mounted on the frame 1 in fixed, parallel relationship to the column 12 carries a stop arm 19*d* vertically movable on a sleeve bearing 46 in guiding engagement with the column 12. A roller 47 at the free end of the arm 19*d* abuttingly engages a vertical panel edge. An adjustable friction element 48 on the sleeve bearing 46 may be stopped on the rod 45 by means of a non-illustrated screw on the rod 45. A rope 50 is attached to the arm 19*d*, trained over a pulley 51 on the top portion of the frame 1, and carries a counterweight 49 which upwardly biases the arm 19*d* on the rod 45.

Prior to starting a horizontal cut S from the left vertical edge of the panel 7, the roller 47 on the stop arm 19*d* is set at a level h immediately above the cut. The upper panel portion 7*a* is clamped by the clamping jaws at a point marked by an arrow $P_1$ and simultaneously supported at a point marked by an arrow $P_2$ by the roller 47.

The saw blade 52 of the power saw 6 passes unimpeded below the stop arm 19*d*, and the severed lower panel portion 7*b* may be removed from the device on the rollers 4 either to the right or the left as indicated by arrows. The upper panel portion 7*a* thereafter may be lowered to the carrier rollers 4 by lowering the slide 13 on the column 12. When the slide 13 strikes the stop arm 19*d*, it shifts the arm downward. After the panel portion 7*a* has been worked up, the slide 13 is returned to the illustrated position, and the counterweight 49 raises the arm 19*d* to the level h.

I claim:

1. A device for cutting a panel comprising: a frame; a vertically extending grid defining a working surface for a panel to be cut while supported by said grid; horizontally extending carrier means adapted to have said panel resting edgewise thereon while being supported by said working surface during cutting of said panel; a power saw mounted on said frame for movement in said working surface; an elongated guide column secured to said frame; stop means on said guide column for bounding said working surface in one horizontal direction by abutting engagement with a vertically extending edge portion of said panel; said guide column being vertically extending adjacent said edge portion when said edge portion is engaged by said stop means; and clamping means vertically movable on said guide column for clamping said edge portion to said column.

2. A device according to claim 1, wherein said guide column is mounted on said frame for movement between an operative position in which a face of said column constitutes said stop means and a retracted position transversely offset from said working surface.

3. A device as set forth in claim 2, wherein said movement of said column is arcuate about a vertically extending axis.

4. A device as set forth in claim 1, wherein said guide column is mounted on said frame for movement between an operative position and a retracted position, a face of said column in said operative position constituting said stop means for defining a working position of said panel, said column in the retracted position being sufficiently removed from said edge portion of a panel in said working position to permit access of said power saw to said edge portion.

5. A device as set forth in claim 1, wherein said column is fixedly fastened to said frame and transversely offset from said surface, said stop means including a carrier member vertically movable on said column, and a plurality of stop members vertically spaced on said carrier member for engagement with said edge portion.

6. A device as set forth in claim 5, wherein said stop means are rotatable about respective axes.

7. A device as set forth in claim 1, wherein said guide column is mounted on said frame and offset from said work surface, said stop means include a stop member mounted on said column and extending therefrom into said working surface, said stop member consisting of a material readily cut by said saw member.

8. A device as set forth in claim 1, wherein said stop means include a guide rod mounted on said frame outside said working surface, and a stop member guided on said rod in a vertically extending direction, said stop member extending from said guide rod toward said working surface for engagement with said edge portion.

9. A device as set forth in claim 8, wherein said stop member is elongated, on longitudinal end portion of said stop member being slidably fastened to said guide rod, the other end portion of the stop member carrying a roller.

10. A device as set forth in claim 8, further comprising biasing means upwardly biasing said stop member on said guide rod, and releasable friction means for preventing upward movement of said stop member under said biasing.

11. A device as set forth in claim 1, wherein said column has three longitudinal faces offset from each other at right angles, and said clamping means include an approximately U-shaped slide extending about said faces and longitudinally movable on said column, said slide having two opposite leg portions carrying respective clamping jaws, one of said jaws being movable toward the other jaw for clamping said edge portion between said jaws.

12. A device as set forth in claim 11, further comprising three rollers mounted on said slide and respectively engaging said faces of said column.

13. A device as set forth in claim 11, further comprising motor-operated drive means for longitudinally moving said slide on said column.

14. A device as set forth in claim 11, further comprising motor-operated drive means for moving said one jaw toward said other jaw.

* * * * *